US006450512B1

(12) United States Patent
Carr

(10) Patent No.: US 6,450,512 B1
(45) Date of Patent: Sep. 17, 2002

(54) HANDLE STRUCTURE FOR A SNOWBOARD

(76) Inventor: Donald W. Carr, 339 Scott Ave., Syracuse, NY (US) 13224

( * ) Notice: Subject to any disclaimer, the term of this patent is extended or adjusted under 35 U.S.C. 154(b) by 0 days.

(21) Appl. No.: 09/075,224

(22) Filed: May 11, 1998

(51) Int. Cl.[7] ..... A63C 5/06
(52) U.S. Cl. ..... 280/14.27; 16/430; 280/809
(58) Field of Search ..... 280/14.2, 809, 280/87.042, 18, 18.1, 14.27, 609; 16/111 R, 119, 110.1, 430

(56) References Cited

U.S. PATENT DOCUMENTS

| | | | | | |
|---|---|---|---|---|---|
| 1,644,623 | A | * | 10/1927 | Ahn | 280/14.27 X |
| 2,392,098 | A | * | 1/1946 | Philippar | 280/14.28 |
| 2,894,760 | A | * | 7/1959 | Kolstad | 280/14.28 X |
| D214,177 | S | * | 5/1969 | Greer | 280/87.042 X |
| 3,581,328 | A | * | 6/1971 | Smith | 280/18.1 X |
| 3,921,239 | A | * | 11/1975 | Sovia et al. | 280/18 X |
| 3,997,187 | A | | 12/1976 | Staufer et al. | |
| 4,262,927 | A | | 4/1981 | Hochstrasser | |
| 4,533,150 | A | * | 8/1985 | Hardy | 280/14.28 |
| 4,674,763 | A | | 6/1987 | Schlagenhaufer | |
| 4,732,399 | A | * | 3/1988 | Reilly et al. | 280/18.1 |
| 4,772,047 | A | | 9/1988 | Leaf | |
| 4,778,710 | A | | 10/1988 | Deutsch | |
| 4,807,896 | A | * | 2/1989 | Philippi | 280/87.042 |
| 4,861,063 | A | | 8/1989 | Abondance | |
| 4,915,400 | A | * | 4/1990 | Chambers | 280/14.27 |
| 5,106,109 | A | * | 4/1992 | Tattersall et al. | 280/18.1 X |
| D327,725 | S | | 7/1992 | Serves et al. | |
| 5,201,659 | A | * | 4/1993 | Nelson | 280/87.042 X |
| 5,310,221 | A | | 5/1994 | Schmidt | |
| 5,397,153 | A | | 3/1995 | Dutaut et al. | |
| 5,405,161 | A | | 4/1995 | Petkov | |
| 5,417,444 | A | * | 5/1995 | Chen | 280/87.042 |
| 5,590,908 | A | | 1/1997 | Carr | |
| 5,609,351 | A | * | 3/1997 | Vermillion | 280/14.22 X |
| 5,618,054 | A | | 4/1997 | Fagot | |
| 5,810,376 | A | * | 9/1998 | Matheny | 280/87.042 |
| 5,816,592 | A | * | 10/1998 | Horton, II | 280/87.041 |
| 5,893,570 | A | * | 4/1999 | Kehrmann | 280/18.1 |
| 5,927,732 | A | * | 7/1999 | Snyder | 280/87.042 X |
| 5,927,734 | A | * | 7/1999 | Horton, II et al. | 280/87.042 |
| 5,947,495 | A | * | 9/1999 | Null et al. | 280/87.042 |

FOREIGN PATENT DOCUMENTS

| | | | | |
|---|---|---|---|---|
| CA | 604520 | * | 9/1960 | 280/18.1 |

* cited by examiner

*Primary Examiner*—Michael Mar
(74) *Attorney, Agent, or Firm*—William H. Bollman

(57) ABSTRACT

A sportsboard such as a snowboard or wakeboard includes board structure having a handle structure defining a generally smooth surface to be grasped by at least a portion of a hand of the user such that (1) the user may remain in contact with the board structure when the bottom surface of the board structure is out of contact with the medium being ridden and (2) the board structure may be transported by hand more easily by the user. In one embodiment, an opening sufficiently sized to receive the forefingers of a rider's hand is formed in at least one end of the sportsboard. In another embodiment, at least two openings are formed on at least one end of the sportsboard, the two openings being on opposite sides of a lengthwise center axis of the sportsboard. In a third embodiment, at least one end of the sportsboard is rolled-up sufficiently to form a lip which can be grasped by the thumb or forefingers of a rider. In another embodiment, a grip member is formed on an outer edge of at least one end of the sportsboard to allow easy gripping, particularly when performing aerial tricks. In other embodiments, a separately molded handle structure is mounted to an upper surface of the sportsboard. Methods of modifying convention sportsboards to provide handle structure thereon are also provided.

12 Claims, 6 Drawing Sheets

HANDLE STRUCTURE FOR A SNOWBOARD

BACKGROUND OF THE INVENTION

1. Field of the Invention

This invention relates generally to sportsboards and more particularly to a sportsboard such as a snowboard, wakeboard or skateboard having a handle structure on at least one end thereof so as to be grasped by a rider while the rider is suspended in air and performing aerobatics, and which may be grasped to transport the sportsboard when not in use.

2. Background of Related Art

Snowboarding is a sport that allows a rider to perform numerous tricks and maneuvers on the slopes. With each season, new and more innovative tricks are developed as riders continually attempt to evolve the sport. In addition to riding skill, a critical part of the evolution of snowboarding has been the transformation of the board itself. New materials and construction techniques have helped make snowboarding the fastest growing of all winter sports.

Snowboarding, as well as other similarly situated sports such as wakeboarding, allow aerial stunts and aerobatics. For instance, many snowboarding tricks are an adaptation of maneuvers developed for skateboarding, a similarly situated sport in which the sportsboard and rider are not attached by any form of binding. While performing tricks, an important element of snowboarding, skateboarding and wakeboarding is the requirement to grasp the sportsboard while suspended in air to add to the difficulty and beauty of the aerobatic maneuver so that the board remains in contact with the rider.

Unlike skateboards and wakeboards, the snowboard requires steel edges to carve through the snow. These generally sharp edges pose a safety concern to any portion of the body that comes into contact with them. Conventionally, gloves are worn by the rider because of environmental conditions but also to prevent the edges of the snowboard from cutting into the hands and wrists when the rider grabs the tip or tail while performing aerobatic tricks. It has been found, however, that the sharp edges tend to damage gloves worn by the riders.

Moreover, wakeboards, while riding on a water surface rather than a snow covered surface as in snowboarding, creates a slippery environment. Here, hands tend to slip off the tip or tail of a conventional wakeboard when grasped quickly as in the midst of an acrobatic maneuver when thrust into the air by the wake of a towing boat.

Furthermore, sportsboards such as snowboards, wakeboards and skateboards are generally awkward and difficult to carry when not being ridden.

Accordingly, there is a need for sportsboards which do not damage a gripping hand, which allow a better grasp in wet or slippery conditions, and/or which provide an easier way to grasp when not being ridden.

SUMMARY OF THE INVENTION

In accordance with the principles of the present invention, a sportsboard comprises an upper surface to contact a user of the sportsboard, a bottom surface opposing the upper surface, a front end, and a rear end. At least one of the front end and rear end include a handle structure defining a generally smooth surface for engagement with at least a portion of a hand of the user.

In accordance with another aspect of the present invention, a snowboard comprises a board structure having an upper surface to contact with a user of the snowboard and an opposing bottom surface to contact with a medium to be ridden. The board structure has a front end and a rear end. At least one of the front end and the rear end include a handle structure constructed and arranged to be grasped by at least a portion of a hand of the user such that the user may remain in contact with the board structure when the bottom surface of the board structure is out of contact with the medium being ridden and such that the board structure may be transported by hand by the user. The handle structure comprises generally smooth surfaces defining at least one opening in the at least one end of the front end and the rear end of the board structure, the at least one opening extending through the board structure from the upper surface to the bottom surface thereof, the at least one opening being sized to receive the portion of the hand of the user such that the user may grasp at least one of the smooth surfaces defining the at least one opening.

In accordance with another aspect, a snowboard comprises a board structure having an upper surface to be fixed with respect to a user of the snowboard and an opposing bottom surface to contact with a medium to be ridden. The board structure has a front end and a rear end. At least one of the front end and the rear end include a handle structure constructed and arranged to be grasped by at least a portion of a hand of the user such that the user may remain in contact with the board structure when the bottom surface of the board structure is out of contact with the medium being ridden and such that the board structure may be transported by hand by the user. The handle structure comprises a curved portion at the at least one of the front end and the rear end of the board structure, the curved portion defining a lip spaced from the upper surface of the board structure. An opening between the lip and the upper surface of the board structure is sized to receive the portion of the hand of the user.

In accordance with yet another aspect, a snowboard comprises an upper surface, a lower surface, and a handle structure adapted and arranged to receive a grasping hand of a user of the snowboard.

In yet another aspect of the present invention, a sportsboard handle comprises a handle having mounting points at opposite sides thereof, the handle being adapted and arranged for mounting to an upper surface of an end of a sportsboard.

A method of modifying a sportsboard having a front end and a rear end in accordance with the present invention comprises mounting a handle structure to at least one of the front end and the rear end of the sportsboard. The handle structure defines an opening sized to receive at least a portion of a hand of a user.

BRIEF DESCRIPTION OF THE DRAWINGS

Features and advantages of the present invention will become apparent to those skilled in the art from the following description with reference to the drawings, in which.

DETAILED DESCRIPTION OF ILLUSTRATIVE EMBODIMENTS

As will be illustrated by the embodiments to be described, the invention provides a sportsboard (e.g., a snowboard, a surfboard, or wakeboard, etc.) with a handle structure defining a generally smooth surface to be grasped by the rider riding the sportsboard over a surface such as snow or water. Although the present invention is described with reference to embodiments relating to snowboards and wakeboards, the principles of the present invention are equally applicable to other related sportsboards (e.g., wind surfer, surfboards and even skateboards). Thus, it is to be appreciated by those of ordinary skill in the art that other conventional sportsboards can be modified or developed using conventional construction techniques so as to include elements described and as recited in the appended claims.

Figure 1:
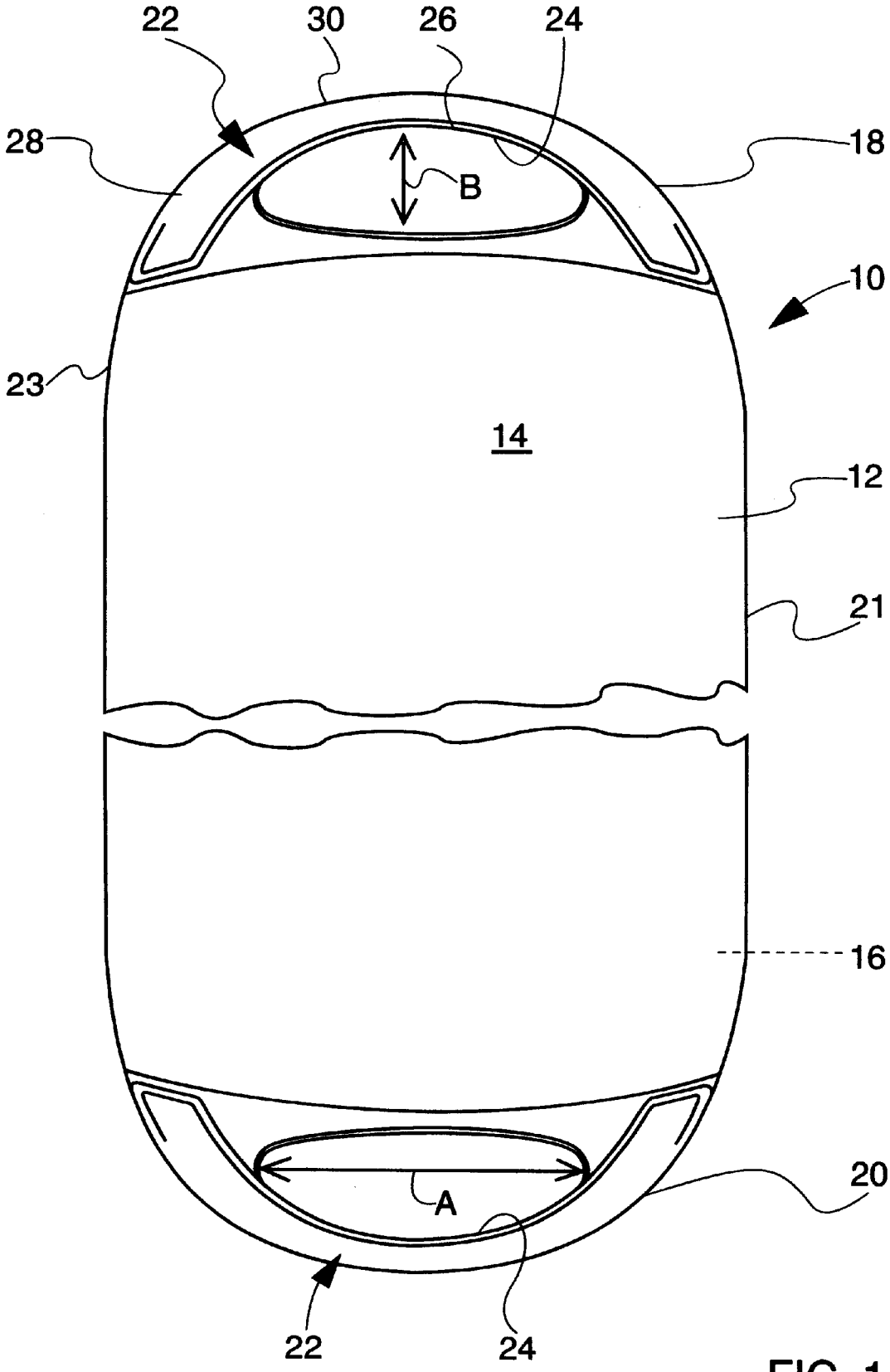
FIG. 1 is a plan view of a first embodiment of a sportsboard provided in accordance with the principles of the present invention.

FIG. 1 shows a sportsboard such as a snowboard or wakeboard, generally indicated at 10, provided in accordance with the principles of a first embodiment of the present invention.

The sportsboard 10 includes a board structure 12 having an upper surface 14 and an opposing bottom surface, indicated by hidden line 16. The upper surface 14 is constructed to contact with a rider or user of the sportsboard 10 and the bottom surface 16 is constructed to contact with a medium to be ridden, such as snow or water. In the case of a skateboard, the bottom surface would include wheels to contact the surface to be ridden.

The board structure 12 has a front end 18 or tip and a rear end 20 or tail. In the case of a snowboard, the board structure 12 includes cutting edges 21 and 23 at each side thereof for use in carving through snow during use.

In accordance with the principles of the present invention, at least one of the front end 18 or rear end 20 includes a handle structure, generally indicated at 22, constructed and arranged to be grasped by at least a portion of a hand of the user. As shown in the embodiment of FIG. 1, each of the front and rear ends 18 and 20 includes identical handle structure 22 comprising surfaces defining an opening 24. Of course, the sportsboard 10 may include only one handle structure, or different handle structures at either end, within the principles of the present invention.

The opening 24 extends through the board structure 12 from the upper surface 14 to the bottom surface 16 thereof. The opening 24 is sized to receive a portion of the hand of the rider such that the rider may grasp at least one surface, in particular the bumper surface 26, which defines at least part of the opening 24, permitting the rider to maintain contact with the board structure 12 while performing aerial tricks.

In the illustrated embodiment of FIG. 1, the opening 24 is generally elliptical in shape and has a width dimension A of at least about 3 inches and a height dimension B of at least about 1 to 2 inches so as to easily receive fingers or a portion of the hand of the user, with or without a glove thereon. Of course, the size of the opening to receive a hand will be preferably adjusted to the fit of the application. For instance, a snowboard will receive a gloved hand and will likely require a larger sized opening than would a wakeboard which would receive a bare hand. It can be appreciated that other shaped openings 24 may be provided which are sized to receive at least a portion of a hand of the user.

As shown in FIG. 1, the handle structure 22 includes a grip or a bumper member 28 generally adjacent to the opening 24. The grip member 28 defines gripping surfaces 26 and 30 and may be composed of generally scuff-resistant, high-impact plastic which is over-molded onto the corresponding front end 18 and/or rear end 20 of the sportsboard 10. Alternatively, the grip member 28 may be attached to the sportsboard 10 with mechanical fasteners. Thus, in the illustrated embodiment, the grip member 28 protrudes from both the upper surface 14 and bottom surface 16 of the board structure 12. It can be appreciated that the grip member 28 may be provided only on the upper surface 14 of the board structure 12 so as to not hinder the movement of the bottom surface 16 with respect to the medium being ridden.

Alternatively, the grip member 28 may be flush with the upper surface 14 and the bottom surface 16. The grip member 28 and entire handle structure 22 may be formed simply by forming an opening 24 in an otherwise conventional sportsboard, e.g., a snowboard or wakeboard.

The grip member 28 ensures that surfaces 26 and 30 are generally smooth surfaces so as not to cut a glove, hand or wrist of the rider when grasping the handle structure 22. Moreover, the grip member 28 acts a bumper to protect the tip 18 and tail 20 of the sportsboard 10 from scuffs and/or bumps.

Figure 2:
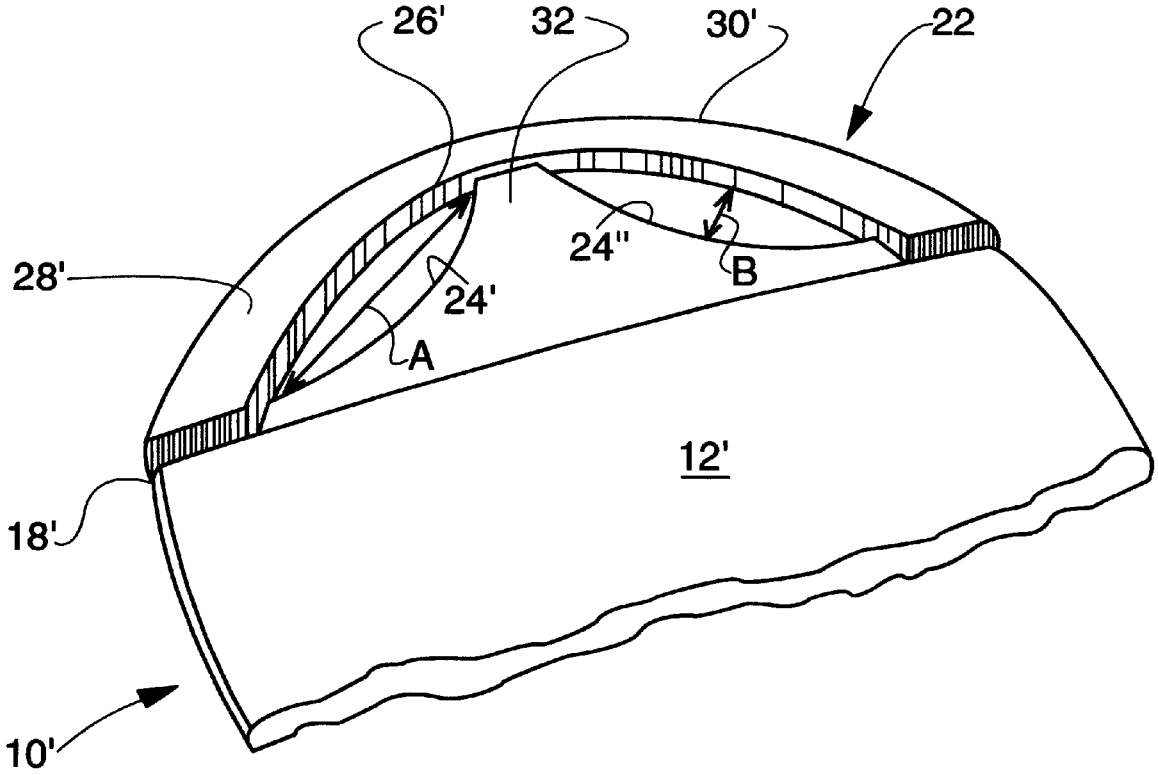
FIG. 2 is a perspective view of a handle structure of second embodiment of a sportsboard provided in accordance with the principles of the present invention.

FIG. 2 shows a second embodiment of a handle structure provided on a sportsboard, generally indicated at 22', provided in accordance with the principles of the present invention.

In particular, a sportsboard 10' comprises a board structure 12'. At least one of the ends 18' of the board structure 12' includes the handle structure 22'. The handle structure 22' comprises surfaces defining a pair of generally adjacent openings 24' and 24" separated by a support member 32. The openings 24' and 24" extend through the board structure 12' from an upper surface to a bottom surface thereof. Each of the openings 24' and 24" is sized to receive a portion of the hand of the rider such that the rider may grasp at least one surface, in particular surface 26', which defines at least part of the openings 24' and 24".

In the illustrated embodiment of FIG. 2, each of the openings 24' and 24" has a width dimension A of at least about 3 inches and a height dimension B of at least about 1 to 2 inches so as to easily receive fingers or a portion of the hand of the user, with or without a glove thereon depending upon the application.

Similar to the embodiment of FIG. 1, the board structure 12' of FIG. 2 includes a grip member 28' generally adjacent to the openings 24' and 24". The grip member 28' defines smooth gripping surfaces 26' and 30' and is composed of generally scuff-resistant, high-impact plastic which is over-molded onto the end 18' of the board structure 12'. Alternatively, the grip member 28' may be attached to the board structure 12' with mechanical fasteners. Moreover, the grip member 28 may be simply formed by the remaining surfaces of the sportsboard having openings 24' and 24" formed therein. Thus, in the illustrated embodiment, the grip member 28' protrudes from both the upper surface and bottom surface of the board structure 12'. As mentioned above with regard to the embodiment of FIG. 1, it can be appreciated that the grip member 28' may be provided only on the upper surface of the board structure 12', and/or may be formed flush with the upper surface and/or bottom surface of the board structure 12'.

It is contemplated that the handle structures 22 and 22' described above be formed integrally into a snowboard or wakeboard, or other sportsboard product. However, it is within the contemplation of the invention to modify a conventional snowboard, wakeboard, or other sportsboard to include a handle structure in accordance with the principles of the present invention. In this case, the handle structure 22 or 22' is a separate part which is attached to at least one end of the conventional snowboard by epoxy, fasteners or other suitable means.

Alternatively, the handle structure 22 or 22' may be provided in a sportsboard such as a snowboard or wakeboard by removing material to create at least one opening through the board at one or both ends thereof. A grip member may additionally be coupled to the front and/or rear end of the board by over-molding, epoxy, or fasteners to provide smooth grasping surfaces forming a handle structure in accordance with the principles of the present invention.

Figure 3:
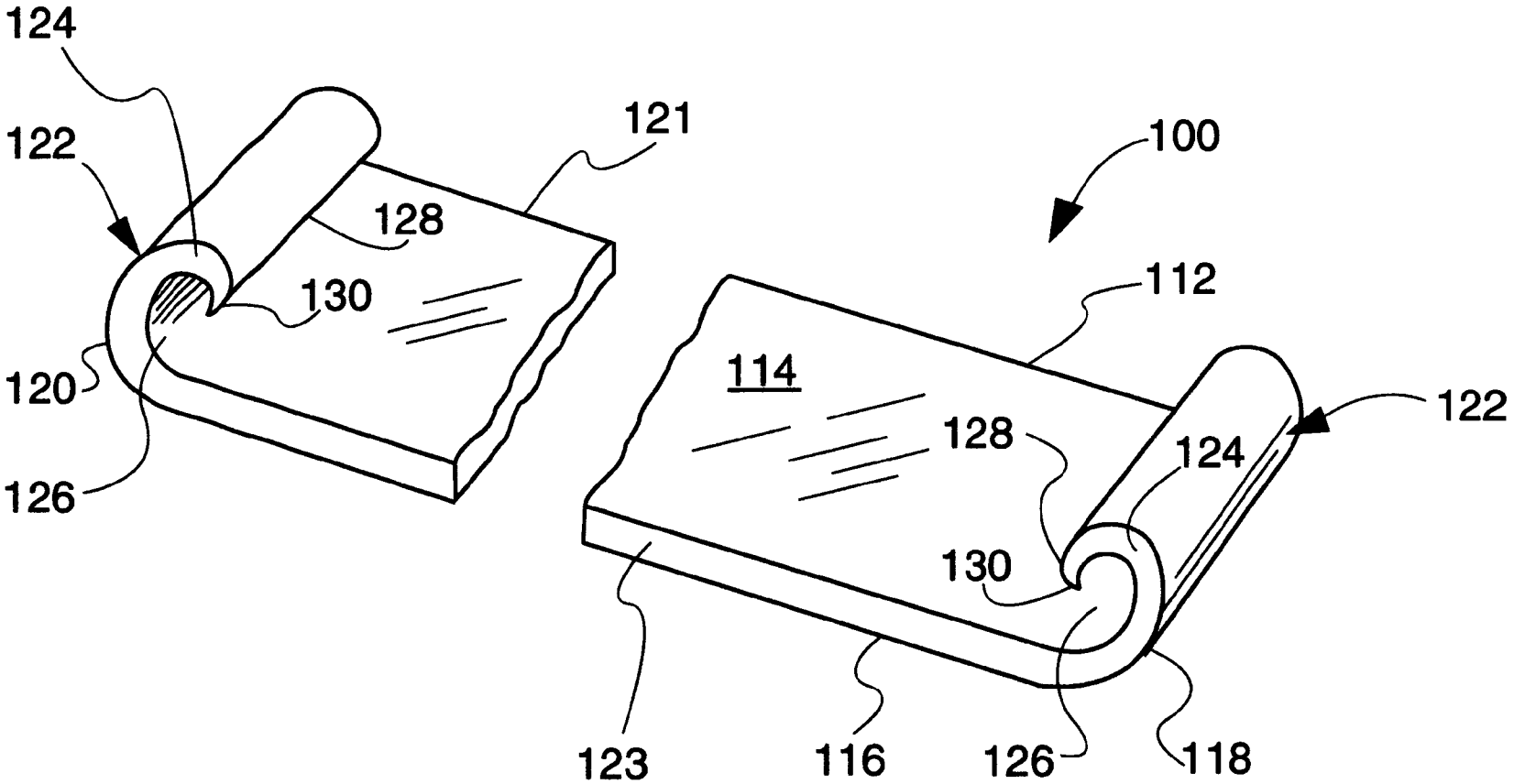
FIG. 3 is a perspective view of a third embodiment of a sportsboard, provided in accordance with the principles of the present invention.

A third embodiment of a sport board in the form of a snowboard or wakeboard is shown in FIG. 3, generally indicated at 100.

In particular, the sportsboard 100 includes a board structure 112 having an upper surface 114 and an opposing bottom surface 116. The upper surface 114 is constructed to contact with a rider of the sportsboard and the bottom surface 116 is constructed to contact with a medium to be ridden, e.g., snow or water. The sportsboard 100 has a front end 118 and a rear end 120. In the case of a snowboard, the board structure 112 includes cutting edges at each edge 121, 123 thereof for use in carving through the snow during use.

In accordance with the principles of the present invention, at least one of the front end 118 and rear end 120 includes a handle structure, generally indicated at 122, constructed and arranged to be grasped by at least a portion of a hand of the user. As shown FIG. 3, each of the front and rear ends 118 and 120 may include identical handle structure 122, although different handle structures or a handle structure only on one end is within the scope of the present invention.

The handle structure 122 of the present embodiment does not protrude through the sportsboard 100 from the upper surface 114 to the bottom surface 116. Instead, the handle structure 122 is formed by a curved portion 124 defining an opening 126 directed the towards the other end of the board structure 112. The curved portion 124 includes a lip 128 which is directed generally perpendicular to the lengthwise direction of the sportsboard. The lip 128 is spaced from the upper surface 114 of the board structure 112 and defines a generally smooth surface 130 convenient for grasping by a rider in the midst of an aerial stunt. The lateral opening 126 is sized to receive a portion of a hand of the user, e.g., a thumb, such that the hand portion may engage with at least a portion of the lip 128, permitting the rider to maintain contact with the board structure 112 while performing aerial ticks. As noted above, the end surface 130 of the lip 128 is a smooth surface ensuring comfortable engagement with a portion of the rider's hand, e.g., the thumb or forefinger.

Figure 4A:
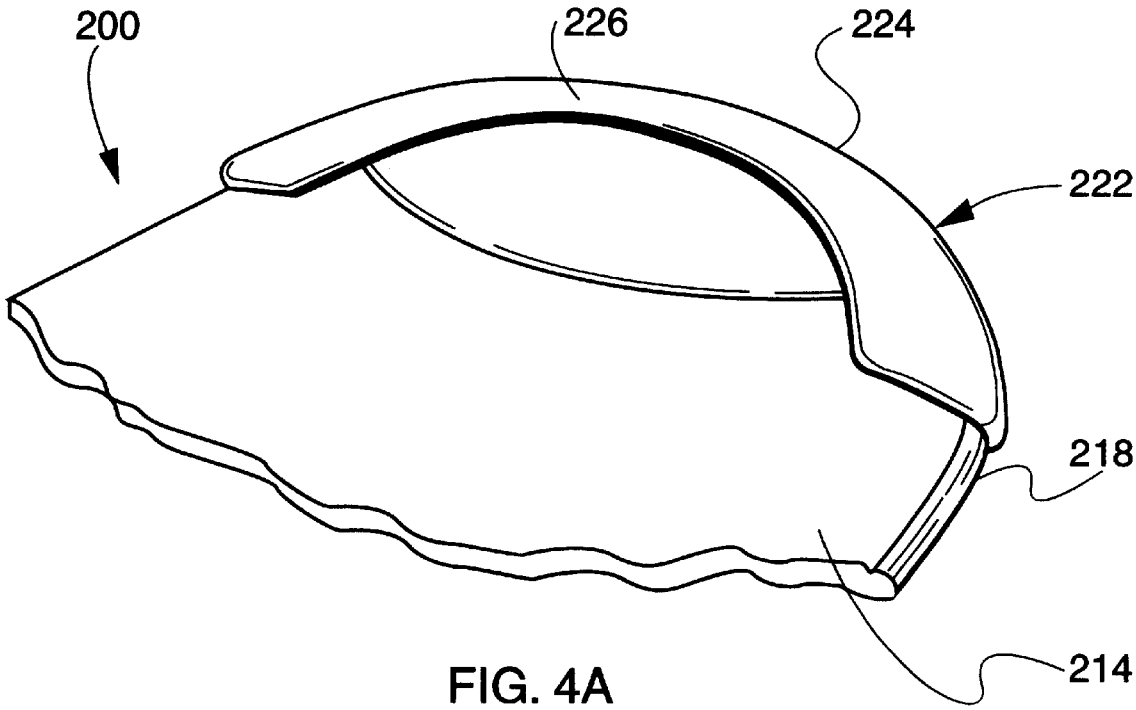
FIGS. 4A and 4B are top and bottom views, respectively, of a fourth embodiment of a sportsboard provided in accordance with the principles of the present invention.
Figure 4B:
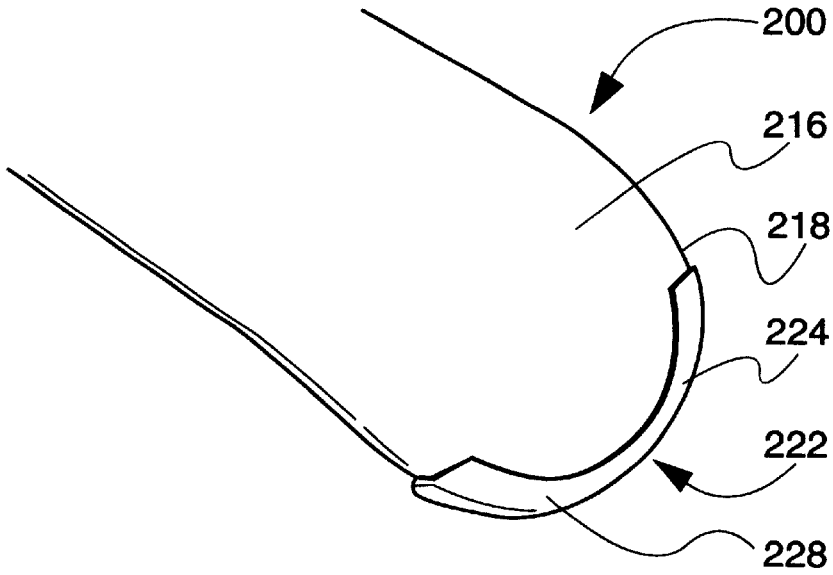

FIGS. 4A and 4B show another embodiment of a handle structure in accordance with another aspect of the present invention.

In particular, a front end or tip portion 218 of a sportsboard 200, e.g., a snowboard or wakeboard, with handle structure 222, is shown in FIGS. 4A and 4B. FIG. 4A is an enlarged view of an upper surface 214 of the tip potion 218 of sportsboard 200, while FIG. 4B shows the bottom surface 216 thereof. The handle structure 222 of the present embodiment does not protrude through the sportsboard 200 from the upper surface 214 to the bottom surface 216. Instead, the handle structure 222 is formed by a grip member 224 protruding outwardly from the upper surface 214 and/or from the bottom surface 216 of the sportsboard thereby defining gripping surfaces 226 and 228 on the upper surface 214 and bottom surface 216, respectively. The gripping surfaces 226 and 228 may receive forefingers and/or a thumb of the rider while performing aerobatics or when transporting the sportsboard 200 when not in use.

Although the handle structure 222 is shown only on the tip portion 218 of sportsboard 200, it can be appreciated that the tail portion (not shown) may include handle structure as well.

The grip member 224 ensures that gripping surfaces 226 and 228 are generally smooth surfaces so as not to cut a glove, hand or wrist of the rider when grasping the handle structure 222. Moreover, the grip member 224 acts as bumper to protect the tip portion 218 and tail portion (if provided thereon) of the sportsboard 200 from scuffs and/or bumps.

Figure 5:
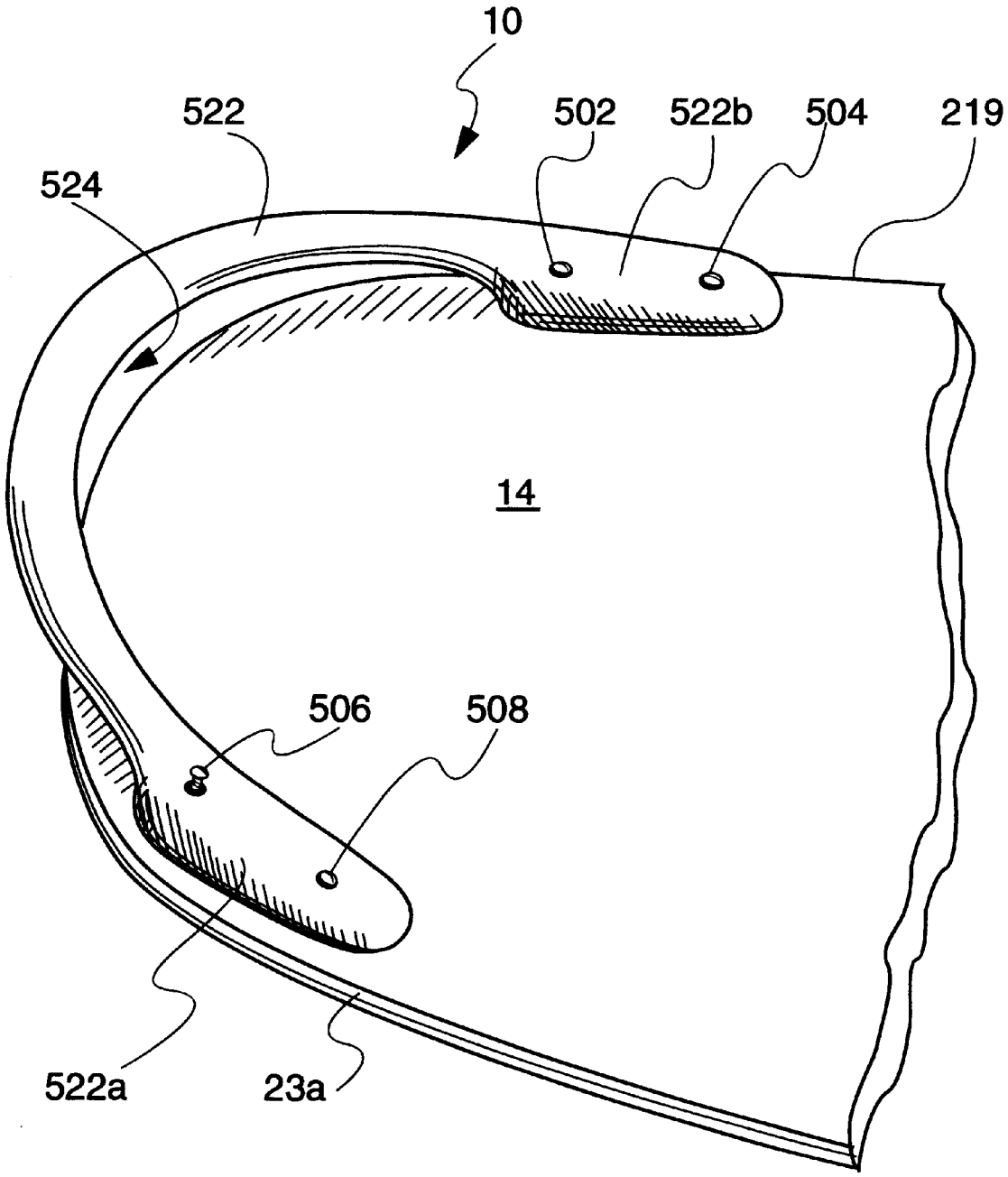
FIG. 5 is a perspective view of yet another embodiment wherein a separately formed handle structure is mounted to an upper surface of a sportsboard such as a snowboard.

FIG. 5 shows yet another embodiment wherein a separately formed handle structure is mounted to the upper surface 14 of an otherwise conventional sportsboard 10 such as a snowboard.

In particular, a radial handle structure 522 provides an opening 524 about the radius of the respective end of the sportsboard 10. The radial handle structure 522 is separately formed, e.g., molded from high-impact plastic. Once formed, the radial handle structure 522 is mounted to the sportsboard 10 by, e.g., a retailer of sportsboard equipment.

One handle structure 522 may be mounted to one end of the sportsboard 10, or two radial handle structures 522 may be mounted to opposite ends of the sportsboard 10. The disclosed radial handle structure 522 shown in FIG. 5 may be mounted with any suitable mechanism. For example, the opposite ends 522*a*, 522*b* of the radial handle structure 522 may be mounted at opposite sides 23*a*, 21*a* of the sportsboard 10, respectively, e.g., with mounting screws 502–508. Alternatively, one or more support rod(s) may be mounted along the periphery of the end of the sportsboard 10 between the sportsboard 10 and the radial handle structure 522 to provide additional support. Conveniently, the handle may be mounted similar to a boot binding in that hidden screws may be used which do not penetrate through the bottom surface of the sportsboard 10.

Figure 6:
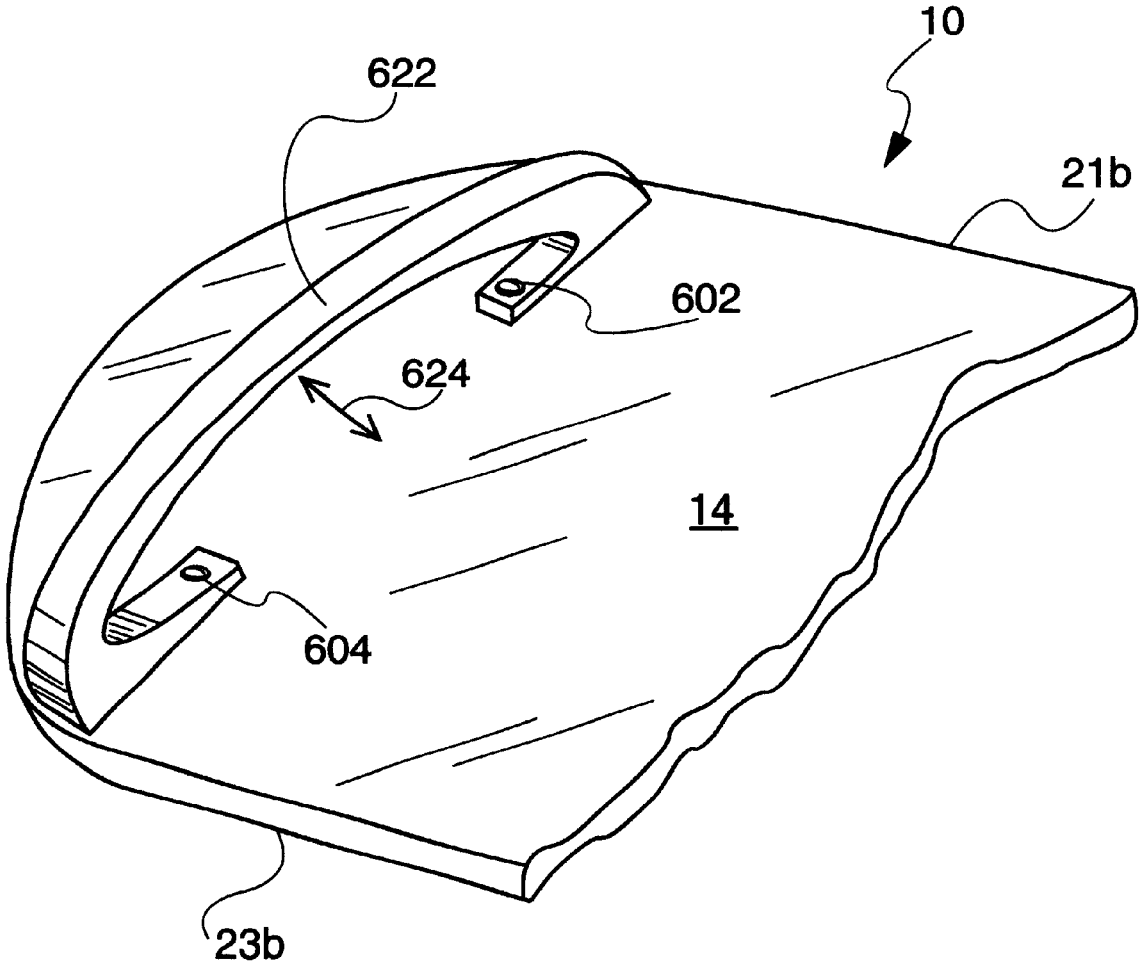
FIG. 6 is a perspective view of another embodiment wherein a separately formed handle structure is mounted to an otherwise conventional sportsboard.

An alternative to the separately formed radial handle structure 522 shown in FIG. 5 is shown in FIG. 6, which is a perspective view of a transverse handle structure mounted to an otherwise conventional sportsboard 10.

In particular, a generally linear handle structure 622 is formed from substantially a first side 21*b* of the sportsboard 10 to an opposite side 23*b* of the sportsboard 10. The linear handle structure 622 forms an opening 624 between an upper surface 14 of the sportsboard 10 and a central portion of the handle structure 622.

The linear handle structure 622 may be mounted, e.g., with suitable mounting screws 602, 604.

As with any design feature that provides additional utility to the performance of a sportsboard, a handle structure in accordance with the principles of the present invention could be used to perform a series of new tricks and innovative maneuvers by a rider, since upon grasping the handle structure, the rider may remain in contact with the board structure when the bottom surface of the board structure is out of contact with the medium being ridden, e.g., the snow or water.

The handle structure also functions as a handle to allow easy transport of the sportsboard when not in use. Moreover, in the case of handle structure including openings, the handle structure provides the added benefit of decreasing aerodynamic drag in a forward-moving direction since air may flow through the opening(s), and adds to the reduction of the overall weight of the sportsboard. Furthermore, the configuration of the handle structure protects riders hands from injury and the ends of the sportsboard from scuffs and abrasions.

While the invention has been described with reference to the exemplary embodiments thereof, those skilled in the art will be able to make various modifications to the described embodiments of the invention without departing from the true spirit and scope of the invention.

What is claimed is:

1. A snowboard, comprising:

a main portion having an upper surface adapted to contact with a mechanical binding to hold a user of said snowboard, a bottom surface opposing said upper surface, and cutting edges at each side of said bottom surface for carving through snow during use;

a front end portion;

a rear end portion; and a handle in at least one of said front end portion and said rear end portion, said handle including an arcuate-shaped support member and a grip member;

said arcuate-shaped support member extending longitudinally toward said main portion and having a maximum width adjacent to said main portion;

said grip member having ends which are fixedly attached to said arcuate-shaped support member at lateral points across said arcuate-shaped support member, and having a central portion which is fixedly attached to said arcuate-shaped support member to form an opening which is sized for receiving a hand of a user.

2. The snowboard according to claim 1, wherein:

a width of said support member is tapered.

3. The snowboard according to claim 2, Wherein:

said grip member is annular-shaped.

4. The snowboard according to claim 3, wherein:

ends of said annular-shaped grip member are free ends.

5. The snowboard according to claim 1, wherein:

said central portion of said grip member forms a pair of laterally spaced openings which are sized for receiving a hand of a user.

6. The snowboard according to claim 5, wherein:

said pair of laterally spaced openings are each sized to receive a hand of said user.

7. The snowboard according to claim 1, wherein:

said opening is laterally spaced.

8. The snowboard according to claim 1, wherein:

said handle is formed of plastic.

9. The snowboard according to claim 1, wherein:

said handle covers at least a portion of at least one cutting edge of said bottom surface of said snowboard.

10. The snowboard according to claim 1, wherein:

said opening has a lateral dimension of at least 3 inches and a longitudinal dimension of at least 1 inch.

11. The snowboard according to claim 1, herein:

said support member caps a tip of said snowboard.

12. The snowboard according to claim 1, wherein:

said grip member protrudes from at least one of said front end portion and said rear end portion of said snowboard.

* * * * *